US006955569B2

(12) United States Patent
Baker et al.

(10) Patent No.: US 6,955,569 B2
(45) Date of Patent: Oct. 18, 2005

(54) BIASED SOCKET CONTACT AND METHOD THEREOF

(75) Inventors: Craig Baker, Shrewsbury, MA (US); Christopher P. Palagi, Upton, MA (US); Danna Anthony Mancini, Worcester, MA (US); Urs F. Nager, Hudson, NH (US); Mark A. Wojcicki, Holden, MA (US)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 10/738,501

(22) Filed: Dec. 17, 2003

(65) Prior Publication Data

US 2004/0219843 A1 Nov. 4, 2004

Related U.S. Application Data

(60) Provisional application No. 60/467,428, filed on May 2, 2003.

(51) Int. Cl.[7] ..... H01R 13/15
(52) U.S. Cl. ..... 439/839
(58) Field of Search ..... 439/839, 833, 439/842, 843, 845, 846, 81, 924.1, 856, 857

(56) References Cited

U.S. PATENT DOCUMENTS

| | | | | |
|---|---|---|---|---|
| 1,677,068 A | | 7/1928 | Alden | |
| 1,936,469 A | * | 11/1933 | Hill | 439/886 |
| 2,346,831 A | | 4/1944 | Drury | |
| 3,316,528 A | * | 4/1967 | Juris et al. | 439/839 |
| 3,862,792 A | | 1/1975 | Jayne | |
| 3,924,922 A | | 12/1975 | DeCenzo | |
| 4,606,599 A | | 8/1986 | Grant et al. | |
| 4,707,050 A | | 11/1987 | Konnemann | |
| 4,772,233 A | | 9/1988 | Hoffman | |
| 5,108,304 A | | 4/1992 | Bogiel et al. | |
| 5,421,314 A | * | 6/1995 | Kidney | 124/44.5 |
| 5,529,517 A | | 6/1996 | Hopf et al. | |
| 5,921,803 A | * | 7/1999 | Mori | 439/843 |
| 6,186,841 B1 | | 2/2001 | Jacobsson | |
| 6,250,974 B1 | | 6/2001 | Kerek | |

OTHER PUBLICATIONS

U.S. Appl. No. 09/375,114, filed Aug. 16, 1999, Baker et al.

* cited by examiner

*Primary Examiner*—Tho D. Ta
*Assistant Examiner*—Felix O. Figueroa
(74) *Attorney, Agent, or Firm*—Nixon Peabody LLP

(57) ABSTRACT

A spring loaded electrical connector system includes a socket contact, at least one biasing element, and a pin contact. The socket contact extends along a first axis and has a base and a plurality of tines which extend out from the base and are arranged around the first axis to define a passage with an open end The biasing element biases at least one of the plurality of tines towards the first axis. The pin contact detachably engages in the passage with the at least one of the plurality of tines biased by the biasing element.

60 Claims, 5 Drawing Sheets

BIASED SOCKET CONTACT AND METHOD THEREOF

This application claims the benefit of U.S. Provisional Patent Application Ser. No. 60/467,428 filed May 2, 2003 which is herein incorporated by reference in its entirety.

FIELD OF THE INVENTION

This invention generally relates to pin and socket connectors and, more particularly, to a biased electrical socket contact and a method thereof.

BACKGROUND OF THE INVENTION

In socket contacts, there are mechanically non-active sections and mechanically active sections. Typically, the mechanically non-active sections of connectors are robust and provide guidance and holding support for a pin. Mechanically active sections provide the contact normal force which is used to create the interface between the pin and socket through which most of the current is conducted.

The pin and socket connectors can be subjected to elevated temperatures. Typically these elevated temperatures are the result of ambient conditions, self-inflicted heat rise because of high operating power levels, or some combination of both.

Unfortunately, these elevated temperatures can also cause the connection between the pin and socket to break down because the mechanically active sections of the connector lose their spring properties and thus automatically lose the normal contact force necessary for low interface resistance. For example, when the temperature in a connector made of copper alloys starts to go over 80 degrees Centigrade (C), the copper alloys lose their spring properties, and thus automatically lose the normal contact force necessary for low interface resistance. This problem becomes even worse with non-symmetrical slotted connectors, such as those disclosed in U.S. patent application Ser. No. 09/375,114 filed on Aug. 16, 1999, for an Electrical Socket Contact with Tines which is herein incorporated by reference in its entirety.

SUMMARY OF THE INVENTION

A connector system in accordance with embodiments of the present invention includes a socket contact, at least one biasing element, and a pin contact. The socket contact extends along a first axis and has a base and a plurality of tines which extend out from the base and are arranged around the first axis to define a passage with an open end The biasing element biases at least one of the plurality of tines towards the first axis. The pin contact detachably engages in the passage with the at least one of the plurality of tines biased by the biasing element.

A socket contact in accordance with embodiments of the present invention includes a base a plurality of tines, and at least one biasing element. The plurality of tines extend out from the base and are arranged to define a passage with an open end. The biasing element biases at least one of the plurality of tines towards the first axis.

A method for making a connector system in accordance with embodiments of the present invention includes providing a socket contact which extends along a first axis. The socket contact has a base and a plurality of tines which extend out from the base and are arranged around the first axis to define a passage with an open end. At least one of the plurality of tines is biased towards the passage with at least one biasing element. A pin contact is provided which can detachably engage in the passage with the at least one of the plurality of tines biased by the biasing element.

A method for making a socket contact in accordance with embodiments of the present invention includes providing a plurality of tines which extend out from a base and are arranged to define a passage with an open end. Biasing at least one of the plurality of tines towards the passage with at least one biasing element.

The present invention provides a robust electrical connector system which can maintain a high constant normal force at elevated temperatures. The present invention achieves this through the use of a biasing element which biases at least one of the tines of a socket contact to engage and provide an electrically conductive, sliding, interference fit with a pin contact. Additionally, the present invention controls the application of the bias provided by the biasing element through the use of a securing mechanism on the outer surface of at least one of the tines of the socket contact.

DETAILED DESCRIPTION

Figure 1:
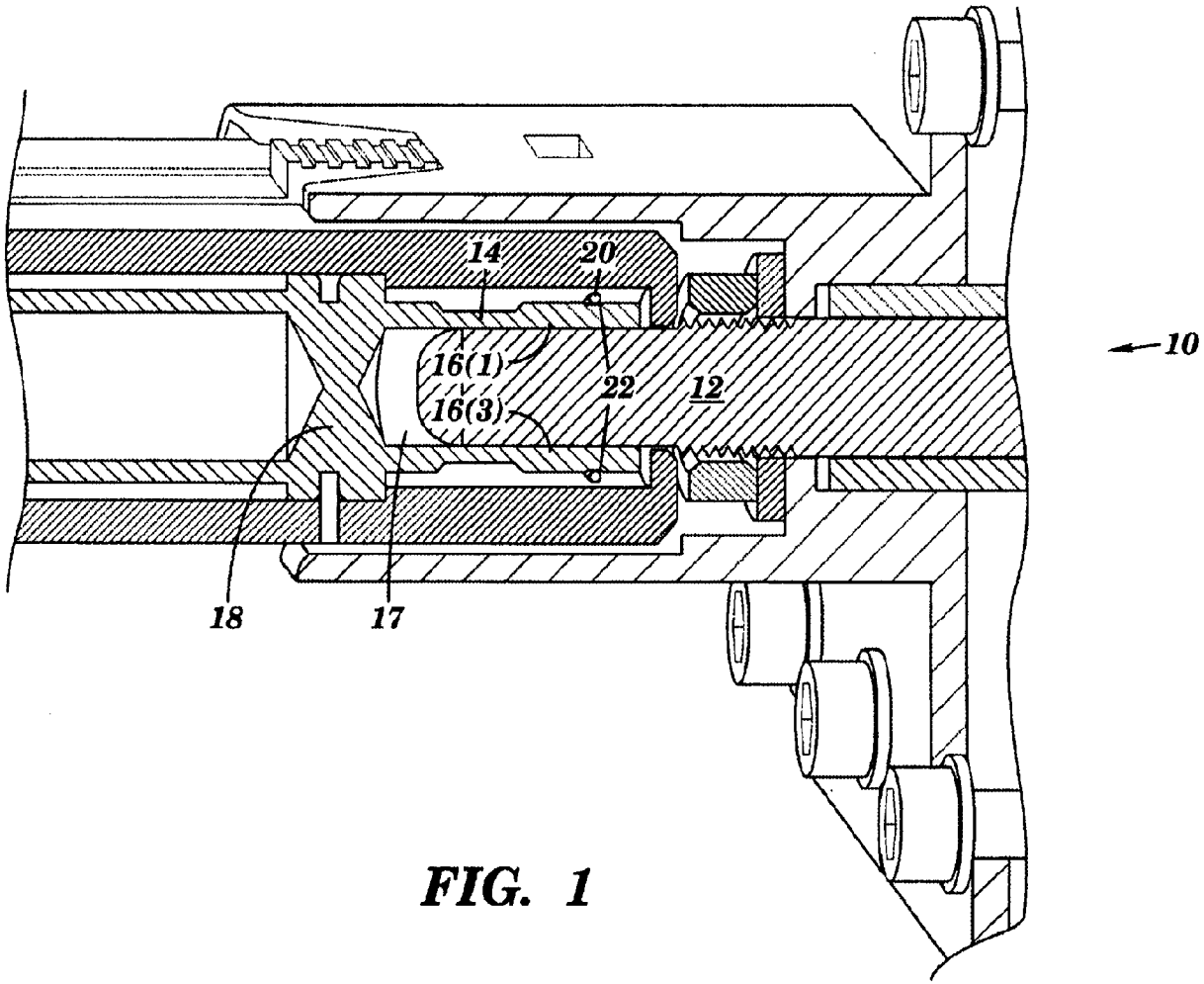
FIG. 1 is a side, perspective, cross-sectional view of an electrical connector system in accordance with embodiments of the present invention.

An electrical connector system 10 in accordance with embodiments of the present invention is illustrated in FIG. 1. The electrical connector system includes a spindle or electrical pin contact 12, an electrical socket contact 14, and a spring element or spring 20, although the electrical connector system 10 may comprise other components, other numbers of the components, and other combinations of the components which are connected together in other manners. The present invention provides a robust electrical connector system 10 which can maintain a high constant normal force at elevated temperatures.

Figure 4:
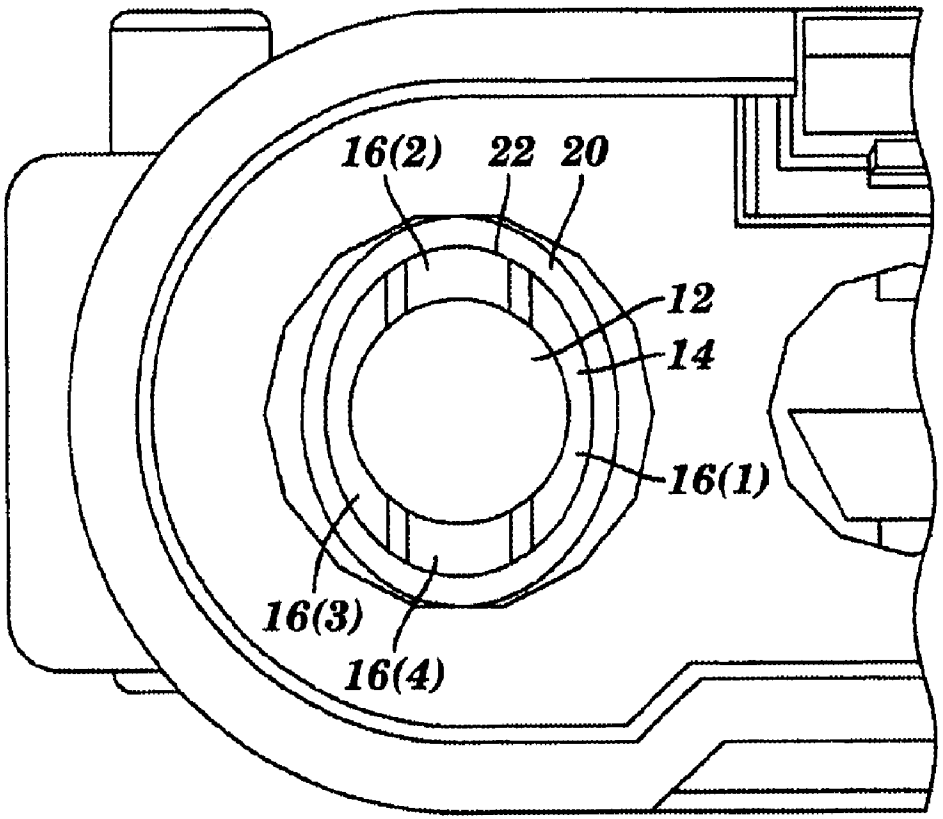
FIG. 4 is an end, cross-sectional view of the electrical connector system.

Referring to FIGS. 1 and 4, the pin contact 12 has an outer shape which is designed to engage in a passage 15 in the socket contact 14 and provide an electrically conductive, sliding, interference fit. The pin contact 12 has a substantially, circular, cross-sectional outer shape, although the pin contact could have other types of shapes, such as a square shape or a hexagon shape. The pin contact 12 is made of a conductive material, such as copper, although other types of conductive materials could be used for the pin contact 12.

Referring to FIGS. 1–5, the socket contact 14 has a plurality of tines or portions 16(1)–16(4) which extend out from a base 18, although the socket contact 14 may comprise other components, other numbers of the components, and other combinations of the components which are connected together in other manners. The tines 16(1)–16(4) are substantially parallel to an axis A—A which extends through the socket contact 14, although the tines 16(1)–16(4) could have other orientations, such as angled toward the axis A—A from the base 18. The tines 16(1)–16(4) are arranged about the axis A—A to define the passage 15 with an open end 17. The passage 15 has a substantially, circular, cross-sectional shape with dimensions which are designed to mate with and provide an electrically conductive, sliding, interference fit with the pin contact 12, although the passage 15 could have other types of shapes, such as a a square shape or a hexagon shape. Although four tines 16(1)–16(4) are shown, the socket contact 14 can have greater or fewer numbers of tines, with other shapes and in other arrangements.

Figure 2:
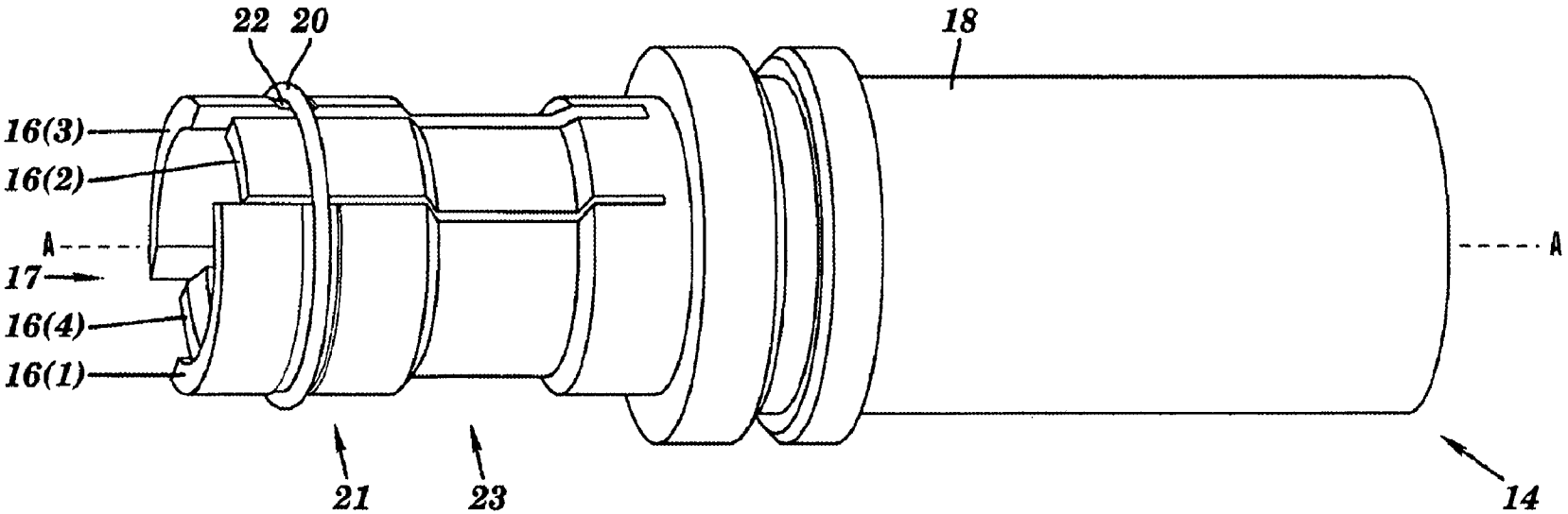
FIG. 2 is perspective view of an electrical socket contact in the electrical connector system.
Figure 3:
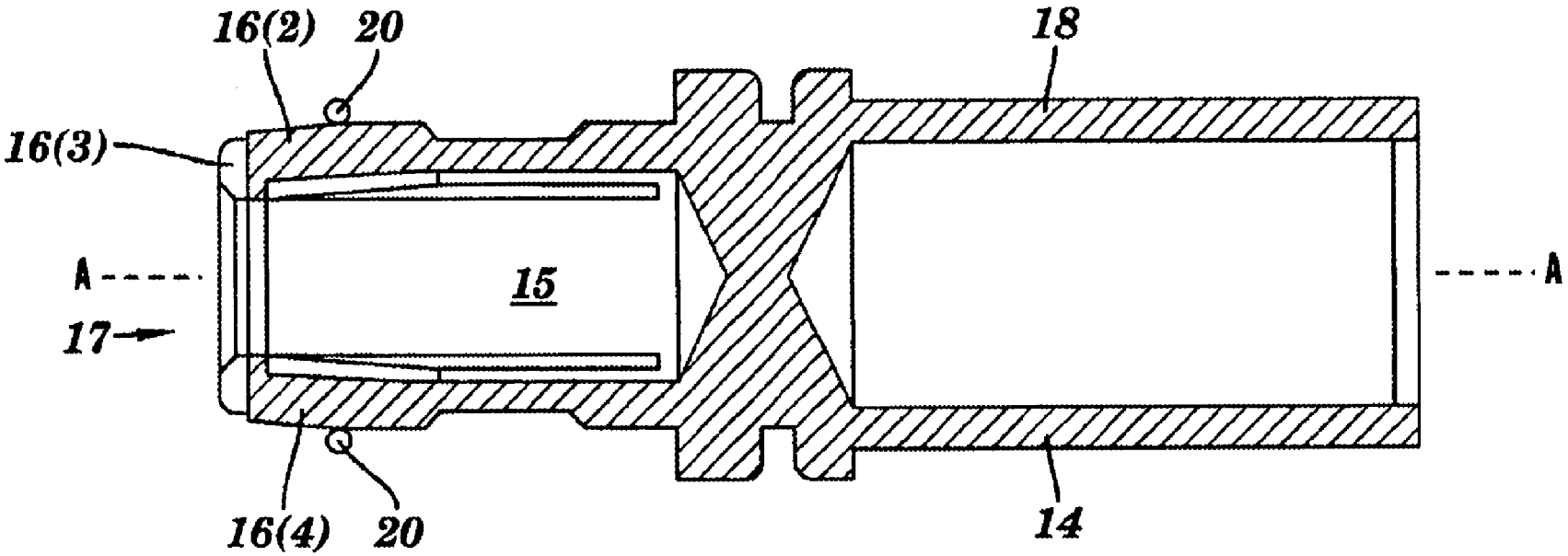
FIG. 3 is side, cross-sectional view of the electrical socket contact.
Figure 5:
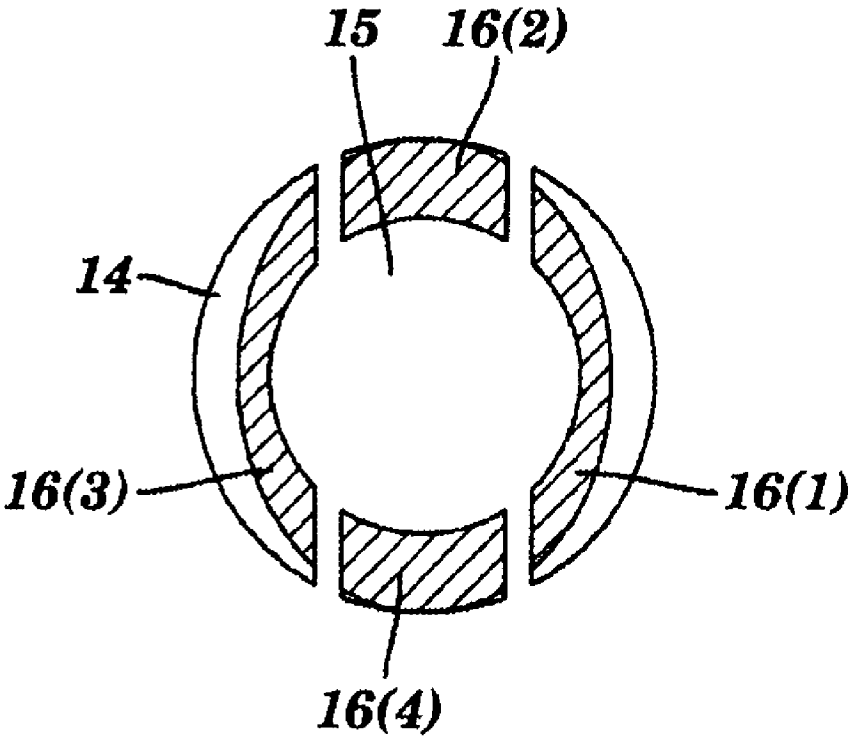
FIG. 5 is an end, cross-sectional view of tines of the electrical socket contact.

Referring to FIGS. 2–3, measured along a general direction of the axis A—A, the length of each of the tines 16(1) and 16(3) is substantially the same and both are longer than the length of each of the tines 16(2) and 16(4), which are also each substantially the same length, although the length of each of the tines 16(1)–16(4) can vary. Referring to FIGS. 2, 4, and 5, measured along a general direction perpendicular to the axis A—A, the width of each of the tines 16(1) and 16(3) is substantially the same and both are wider than the width of each of the tines 16(2) and 16(4), which are also each substantially the same width, although the width of each of the tines 16(1)–16(4) can vary. By way of example only, in this embodiment the length of times 16(1) and 16(3) is 0.675", the width of tines 16(1) and 16(3) is 0.200", the length of times 16(2) and 16(4) is 0.725", the width of tines 16(2) and 16(4) is 0.490".

Referring to FIGS. 1–5, the tines 16(1) and 16(3) are made to be substantially rigid, while tines 16(2) and 16(4) are made to be substantially flexible, although other arrangements for the amount of the rigidity and flexibility of the tines 16(1)–16(4) can be used. The tines 16(1) and 16(3) which are longer, wider, and substantially rigid, act as arc receiving tines which engage and disengage the pin contact 12 in a make-first/break-last relationship. The tines 16(1) and 16(3) provide robust guiding and holding for the pin contact 12 and an area for arcing during hot plugging. The tines 16(2) and 16(4), which are shorter, narrower, and substantially flexible, are biased towards the axis A—A and are used to engage with and provide an electrically conductive, sliding, interference fit with the pin contact 12 when inserted in passage 15.

Referring to FIGS. 1–3, the base 18 of the socket contact 14 is designed to be coupled to a conductor, such as a power line. The base 18 has a substantially, circular, cross-sectional outer shape, although the base 18 could have other types of shapes. The base 18 is also made of a conductive material, such as copper, although other types of conductive materials could be used for the base 18.

Referring to FIGS. 1–4, and 5, an elliptical shaped, slot or groove 22 is used to secure the position of the spring element 20 on the tines 16(1)–16(4). The groove 22 is formed along an outer surface of the times 16(1) and 16(3) of the socket contact 14 so that spring 20 rests in the groove 22 in tines 16(1) and 16(3) and against tines 16(2) and 16(4), although the groove 22 could be formed in other locations and in other numbers of the tines, such as extending into all of the tines 16(1)–16(4). The groove 20 is located in a full-diameter section 21 of the tines 16(1)–16(4) near the open end 17 of the socket contact 14 and which is forward of a reduced or "neck-down" section 23 of the tines 16(1)–16(4), although the groove 22 could be in other locations on times 16(1)–16(4). Additionally, although a groove 22 is shown, other types of securing mechanisms for securing the position of the spring element 20 on or against the socket contact 14 to bias the tines of could be used.

Referring to FIGS. 1–4, the spring element 20 is placed in the elliptical groove 22 in the tines 16(1) and 16(3) and against tines 16(2) and 16(4) near the open end 17 of the socket contact 14, although other types of biasing elements and other numbers of biasing elements could be used. The spring element 20 biases the tines 16(2) and 16(4) towards the axis A—A to engage with and provide an electrically conductive, sliding, interference fit with the pin contact 12 delivering the high normal force selectively only to the active tines 16(2) and 16(4), where it is mostly needed. With the spring element 20 secured in place in the elliptical groove 22, the action points at the tines 16(2) and 16(4) where the high normal force is needed can be controlled. The spring element 20 has a substantially round outer shape and is made of steel, although the spring element could have other shapes and could be made of other materials. The spring element 20 is also a high temperature spring element which does not lose its spring properties even above about 80 degrees C. up to elevated temperatures of about 135 degrees C.

Referring to FIGS. 1–5, a method for making the electrical connector system 10 will be described. The plurality of tines 16(1)–16(4) are formed in one end of the socket contact 14 extending from a base 18. As described in greater detail earlier, the tines 16(1) and 16(3) are formed to be longer and wider than the tines 16(2) and 16(4). Additionally, the tines 16(1) and 16(3) are formed to be substantially rigid and the tines 16(2) and 16(4) are formed to be substantially flexible. The rigidity and flexibility of the tines 16(1)–16(4) can be accomplished in a number of different manners, such as through the use of different materials for the tines 16(1) and 16(3) than for the tines 16(2) and 16(4), through adjustments in the respective length, width, and/or thickness of the tines 16(1) and 16(3) as compared against the tines 16(2) and 16(4), or though different machining of the tines 16(2) and 16(4) to increase the flexibility of those tines.

Next, the groove 22 is formed in an outer surface of tines 16(1) and 16(3) to extend around the socket contact 14, although the groove could be formed in other manners, such as in tines 16(1)–16(4) and other types of securing mechanisms to position the spring 20 can be used. Once the groove 22 is formed, the spring 20 is seated in the groove 22 to bias the tines 16(2) and 16(4) in a direction towards axis A—A.

A pin contact 12 having an outer shape which will mate with the passage 15 and provide an electrically conductive, sliding, interference fit with the socket contact 14 is formed. As described earlier, the pin contact 12 has a substantially, circular, cross-sectional outer shape, although the pin contact could have other types of shapes.

Referring to FIGS. 1–4, the operation of the electrical socket connection 10 will be described. To form an electrical connection, the pin contact 12 is brought towards the opening 17 to the passage 15 in the socket contact 14. The pin contact 12 first engages with the longer, wider, and substantially rigid tines 16(1) and 16(3). As described earlier, the tines 16(1) and 16(3) provide robust guiding and holding for the pin contact 12 and an area for arcing during hot plugging.

As the pin contact 12 is pushed further into the passage 15 of the socket contact 14, the pin contact 12 engages with the tines 16(2) and 16(4). The tines 16(2) and 16(4) are biased by the spring 20 in a direction towards the axis A—A. This engagement between the pin contact 12 and tines 16(2) and 16(4) provides an electrically conductive, sliding, interference fit. With the spring 20, the tines 16(2) and 16(4) do not lose their spring properties at elevated temperatures as described earlier.

Accordingly, the present invention provides a robust electrical connector system 10 which can maintain a high constant normal force at elevated temperatures. In addition to being robust, the electrical connector system 10 is relatively easy to manufacture.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. A connector system comprising:

a socket contact which extends along a first axis, the socket contact has a base and a plurality of tines which extend out from the base and are arranged around the first axis to define a passage with an open end;

at least one biasing element that biases at least one of the plurality of tines towards the first axis, wherein the at least one of the plurality of tines biased by the biasing element is substantially flexible and the remaining one or more of the plurality of tines which are not biased by the biasing element are substantially rigid; and a pin contact which can detachably engage in the passage with the at least one of the plurality of tines biased by the biasing element.

2. The system as set forth in claim 1 wherein the socket contact further comprises at least one securing mechanism which secures a position of the biasing element on at least one of the plurality of tines.

3. The system as set forth in claim 2 wherein the securing mechanism is at least one groove formed along an outer surface of at least one of the plurality of tines, the at least one biasing element is seated in the at least one groove.

4. The system as set forth in claim 3 wherein the at least one groove has an elliptical shape.

5. The system as set forth in claim 1 wherein the remaining one or more of the plurality of tines which are not biased by the biasing element have a greater length than the at least one of the plurality of tines biased by the biasing element.

6. The system as set forth in claim 1 wherein the remaining one or more of the plurality of tines which are not biased by the biasing element have a greater width than the at least one of the plurality of tines biased by the biasing element.

7. The system as set forth in claim 1 wherein the biasing element is a spring.

8. The system as set forth in claim 1 wherein the biasing element maintains normal biasing properties up to about 135 degrees C.

9. A socket contact comprising:

a base which extends at least partially along a first axis;

a plurality of tines which extend out from the base and are arranged to define a passage with an open end; and at least one biasing element that biases at least one of the plurality of tines towards the first axis, wherein the at least one of the plurality of tines biased by the biasing element is substantially flexible and wherein the remaining one or more of the plurality of tines which are not biased by the biasing element are substantially rigid.

10. The contact as set forth in claim 9 further comprising at least one securing mechanism which secures a position of the biasing element on at least one of the plurality of tines.

11. The contact as set forth in claim 10 wherein the securing mechanism is at least one groove formed along an outer surface of at least one of the plurality of tines, the at least one biasing element is seated in the at least one groove.

12. The contact as set forth in claim 10 wherein the at least one groove has an elliptical shape.

13. The contact as set forth in claim 9 wherein the remaining one or more of the plurality of tines which are not biased by the biasing element have a greater width than the at least one of the plurality of tines biased by the biasing element.

14. The contact as set forth in claim 9 wherein the remaining one or more of the plurality of tines which are not biased by the biasing element have a greater width than the at least one of the plurality of tines biased by the biasing element.

15. The contact as set forth in claim 9 wherein the biasing element is a spring.

16. The contact as set forth in claim 9 wherein the biasing element maintains normal biasing properties up to about 135 degrees C.

17. A method for making a connector system, the method comprising:

providing a socket contact which extends along a first axis, the socket contact has a base and a plurality of tines which extend out from the base and are arranged around the first axis to define a passage with an open end;

biasing at least one of the plurality of tines towards the passage with at least one biasing element, wherein the at least one of the plurality of tines biased by the biasing element is substantially flexible and the remaining one or more of the plurality of tines which are not biased by the biasing element are substantially rigid; and providing a pin contact which can detachably engage in the passage with the at least one of the plurality of tines biased by the biasing element.

18. The method as set forth in claim 17 wherein the method further comprises securing a position of the biasing element on at least one of the plurality of tines with a securing mechanism.

19. The method as set forth in claim 18 wherein the securing mechanism is at least one groove formed along an outer surface of at least one of the plurality of tines, the at least one biasing element is seated in the at least one groove.

20. The method as set forth in claim 19 wherein the at least one groove has an elliptical shape.

21. The method as set forth in claim 17 wherein the remaining one or more of the plurality of tines which are not biased by the biasing element have a greater length than the at least one of the plurality of tines biased by the biasing element.

22. The method as set forth in claim 17 wherein the remaining one or more of the plurality of tines which are not biased by the biasing element have a greater width than the at least one of the plurality of tines biased by the biasing element.

23. The method as set forth in claim 17 wherein the biasing element is a spring.

24. The method as set forth in claim 17 wherein the biasing element maintains normal biasing properties up to about 135 degrees C.

25. A method for making a socket contact, the method comprising:

providing a plurality of tines which extend out from a base and are arranged to define a passage with an open end; and biasing at least one of the plurality of tines towards the passage with at least one biasing element, wherein the at least one of the plurality of tines biased by the biasing element is substantially flexible and the remaining one or more of the plurality of tines which are not biased by the biasing element are substantially rigid.

26. The method as set forth in claim 25 further comprising securing a position of the biasing element on at least one of the plurality of tines with at least one securing mechanism.

27. The method as set forth in claim 26 wherein the securing mechanism is at least one groove formed along an outer surface of at least one of the plurality of tines, the at least one biasing element is seated in the at least one groove.

28. The method as set forth in claim 27 wherein the at least one groove has an elliptical shape.

29. The method as set forth in claim 25 wherein the remaining one or more of the plurality of tines which are not biased by the biasing element have a greater length than the at least one of the plurality of tines biased by the biasing element.

30. The method as set forth in claim 25 wherein the remaining one or more of the plurality of tines which are not biased by the biasing element have a greater width than the at least one of the plurality of tines biased by the biasing element.

31. The method as set forth in claim 25 wherein the biasing element is a spring.

32. The method as set forth in claim 25 wherein the biasing element maintains normal biasing properties up to about 135 degrees C.

33. A connector system comprising:

a socket contact which extends along a first axis, the socket contact has a base and a plurality of tines which extend out from the base and are arranged around the first axis to define a passage with an open end;

at least one biasing element that biases at least one of the plurality of tines towards the first axis, wherein at least one of the plurality of tines biased by the biasing element is substantially flexible and at least one of the remaining one or more of the plurality of tines which is not biased by the biasing element is substantially rigid;

at least one securing system that secures the at least one biasing element with respect to at least one of the plurality of tines; and a pin contact which can detachably engage in the passage with the at least one of the plurality of tines biased by the biasing element.

34. The system as set forth in claim 33 wherein the securing system comprises at least one groove along an outer surface of at least one of the plurality of tines, wherein the at least one biasing element is at least partially seated in the groove.

35. The system as set forth in claim 34 wherein the at least one groove has an elliptical shape.

36. The system as set forth in claim 33 wherein at least one of the remaining one or more of the plurality of tines which is not biased by the biasing element has a greater length than the at least one of the plurality of tines biased by the biasing element.

37. The system as set forth in claim 33 wherein at least one of the remaining one or more of the plurality of tines which is not biased by the biasing element has a greater width than the at least one of the plurality of tines biased by the biasing element.

38. The system as set forth in claim 33 wherein the biasing element is a spring.

39. The system as set forth in claim 33 wherein the biasing element maintains normal biasing properties up to about 135 degrees C.

40. A socket contact comprising:

a base;

a plurality of tines which extend out from the base and are arranged to define a passage with an open end;

at least one biasing element that biases at least one of the plurality of tines, wherein at least one of the plurality of tines biased by the biasing element is substantially flexible and at least one of the remaining one or more of the plurality of tines which is not biased by the biasing element is substantially rigid; and at least one securing system that secures the at least one biasing element with respect to at least one of the plurality of tines.

41. The system as set forth in claim 40 wherein the securing system comprises at least one groove along an outer surface of at least one of the plurality of tines, wherein the at least one biasing element is at least partially seated in the groove.

42. The system as set forth in claim 41 wherein the at least one groove has an elliptical shape.

43. The contact as set forth in claim 40 wherein at least one of the remaining one or more of the plurality of tines which is not biased by the biasing element has a greater length than the at least one of the plurality of tines biased by the biasing element.

44. The contact as set forth in claim 40 wherein at least one of the remaining one or more of the plurality of tines which is not biased by the biasing element has a greater width than the at least one of the plurality of tines biased by the biasing element.

45. The contact as set forth in claim 40 wherein the biasing element is a spring.

46. The contact as set forth in claim 40 wherein the biasing element maintains normal biasing properties up to about 135 degrees C.

47. A method for making a connector system, the method comprising:

providing a socket contact which extends along a first axis, the socket contact has a base and a plurality of tines which extend out from the base and are arranged around the first axis to define a passage with an open end;

securing at least one biasing element with respect to at least one of the plurality of tines;

biasing at least one of the plurality of tines towards the passage with the at least one biasing element, wherein at least one of the plurality of tines biased by the biasing element is substantially flexible and at least one of the remaining one or more of the plurality of tines which is not biased by the biasing element is substantially rigid; and providing a pin contact which can detachably engage in the passage with the at least one of the plurality of tines biased by the biasing element.

48. The system as set forth in claim 47 wherein the securing further comprises seating the at least one biasing element in at least one groove along an outer surface of at least one of the plurality of tines.

49. The system as set forth in claim 47 wherein the at least one groove has an elliptical shape.

50. The method as set forth in claim 47 wherein at least one of the remaining one or more of the plurality of tines which is not biased by the biasing element has a greater length than the at least one of the plurality of tines biased by the biasing element.

51. The method as set forth in claim 47 wherein at least one of the remaining one or more of the plurality of tines which is not biased by the biasing element has a greater width than the at least one of the plurality of tines biased by the biasing element.

52. The method as set forth in claim 47 wherein the biasing element is a spring.

53. The method as set forth in claim 47 wherein the biasing element maintains normal biasing properties up to about 135 degrees C.

54. A method for making a socket contact, the method comprising:

providing a plurality of tines which extend out from a base and are arranged to define a passage with an open end;

securing at least one biasing element with respect to at least one of the plurality of tines; and biasing at least one of the plurality of tines towards the passage with the at least one biasing element, wherein at least one of the plurality of tines biased by the biasing element is substantially flexible and at least one of the remaining one or more of the plurality of tines which is not biased by the biasing element is substantially rigid.

55. The system as set forth in claim 54 wherein the securing further comprises seating the at least one biasing element in at least one groove along an outer surface of at least one of the plurality of tines.

56. The system as set forth in claim 54 wherein the at least one groove has an elliptical shape.

57. The method as set forth in claim 54 wherein the remaining one or more of the plurality of tines which are not biased by the biasing element have a greater length than the at least one of the plurality of tines biased by the biasing element.

58. The method as set forth in claim 54 wherein the remaining one or more of the plurality of tines which is not biased by the biasing element has a greater width than the at least one of the plurality of tines biased by the biasing element.

59. The method as set forth in claim 54 wherein the biasing element is a spring.

60. The method as set forth in claim 54 wherein the biasing element maintains normal biasing properties up to about 135 degrees C.

* * * * *